United States Patent [19]

Kuo

[11] Patent Number: 5,071,099

[45] Date of Patent: Dec. 10, 1991

[54] WALL FIXTURE

[76] Inventor: Andy Kuo, No. 1-6, Lane 1010, Chung-Shan Rd., Shen-Kang Hsiang, Taichung Hsien, Taiwan

[21] Appl. No.: 636,616

[22] Filed: Jan. 2, 1991

[51] Int. Cl.[5] ..... A47G 29/00

[52] U.S. Cl. ..... 248/222.1; 248/251

[58] Field of Search ..... 248/222.4, 222.1, 222.3, 248/223.2, 224.3, 224.4, 254, 251, 262, 345, 304, 343; 403/258, 260

[56] References Cited

U.S. PATENT DOCUMENTS

| | | | |
|---|---|---|---|
| 1,778,611 | 10/1930 | Sprigg | 248/224.4 |
| 2,577,838 | 12/1951 | Baldwin | 403/258 |
| 3,198,462 | 8/1965 | Schultz | 248/343 |
| 4,907,771 | 3/1990 | Wang | 248/251 |
| 4,979,713 | 12/1990 | Bell | 248/224.3 |
| 4,998,701 | 3/1991 | Rawald | 248/224.3 |

*Primary Examiner*—Ramon O. Ramirez
*Assistant Examiner*—Robert A. Olson
*Attorney, Agent, or Firm*—Ladas & Parry

[57] ABSTRACT

A wall fixture includes a post, a disc member, a cover plate and a locking piece. The post has a top end with a recessed hole and a bottom end with threaded socket. The disc member has a recessed groove formed therein. The recessed groove has a central protrusion portion extending upward of the same. A through-hole is formed in the protrusion portion. Two pairs of holes are provided on the plate member. One pair of the holes is specially designed to have a narrow portion and a large portion. A cover plate with a second rectangular hole therein, is provided on the disc member. When the post is mounted on the cover plate, the socket in the bottom end of the post, and both rectangular holes (of the cover plate and the disc member) are aligned.

2 Claims, 6 Drawing Sheets

WALL FIXTURE

BACKGROUND OF THE INVENTION

1. Field of Invention

The invention relates to a wall fixture, more specifically to the construction of said wall fixture.

2. Description of the Related Art

FIG. 1 shows a wall fixture (1) of the prior art. Accordingly, the wall fixture includes a post (2) engaged to a disc member (3) by means of a screw (A). The disc member has three positioning studs (3*a*) protruding from the underside of the same by which the disc member can be positioned on a plate member (4). The disc member (3) further includes an inwardly extended recess with a hole (3*b*) in one portion of its outer wall. The plate member (4) is first fixed on the wall, then the disc member (3) is mounted on the plate member by means of the three studs (3*a*) and secured through the hole (3*b*) with a screw (3*c*).

The disc member (3) of said wall fixture (1) is generally made by casting or forging methods, which limits variation of its construction, and increases the cost of manufacturing.

The side of the plate member on which the screw (3*c*) is secured is inclined, therefore the engagement of the disc with the plate is not very durable. It may loosen or slip over time. In addition, the hole (3*b*) in the outer surface of the disc member damages the outward appearance of the same.

SUMMARY OF THE INVENTION

Therefore, the main feature of the present invention is to provide a wall fixture which does not have the aforesaid drawbacks.

The wall fixture of the present invention, includes a post, a disc member, a cover plate and a locking piece. The post has a top end and a bottom end. The top end of the post includes a large head with a groove which is in perpendicular to the axis of the post. The bottom end of the same has a threaded socket of predetermined length. The disc member has a recessed groove therein. A central protrusion portion extends upward from the recessed groove. The protrusion portion has a first through-hole therethrough. Two pairs of holes are provided in the recessed groove, on either sides of the protrusion portion of the same. A cover plate has a second rectangular hole, and when the cover plate is properly placed over the disc member, the cover plate abuts the protrusion portion of the disc member and covers the same while the first and second holes are aligned. The post is placed on the disc member so that the socket in the bottom end of the same is also aligned with the two holes. They are in locked together by a screw member.

BRIEF DESCRIPTION OF THE DRAWINGS

Other features and advantages of the present invention will become apparent in following detailed description, including drawings, all of which show a non-limiting form of the invention, and of which.

DETAILED DESCRIPTION OF THE PREFERRED EMBODIMENT

Figure 1:
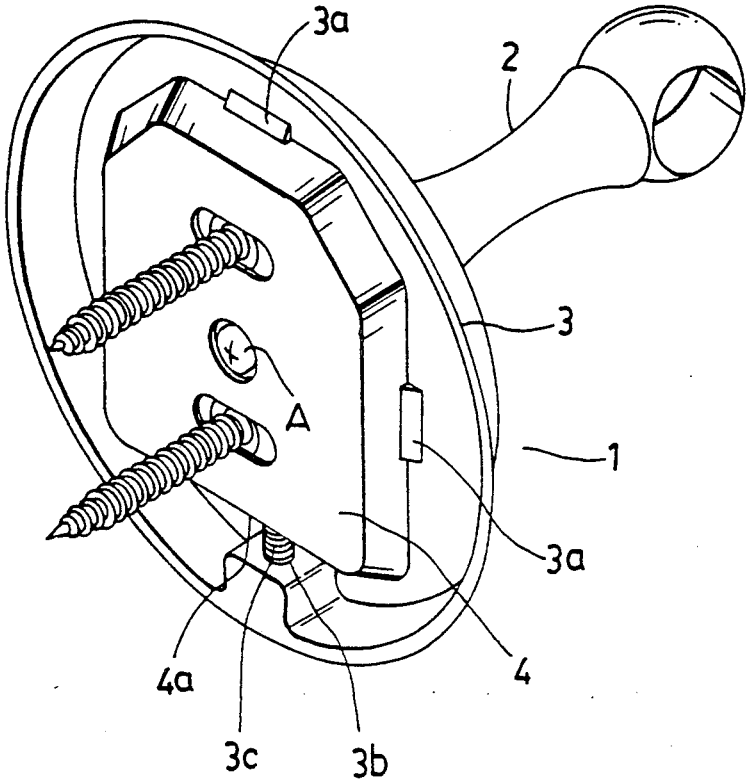
FIG. 1 PRIOR ART
FIG. 1 is a wall fixture of the prior art.
Figure 2:
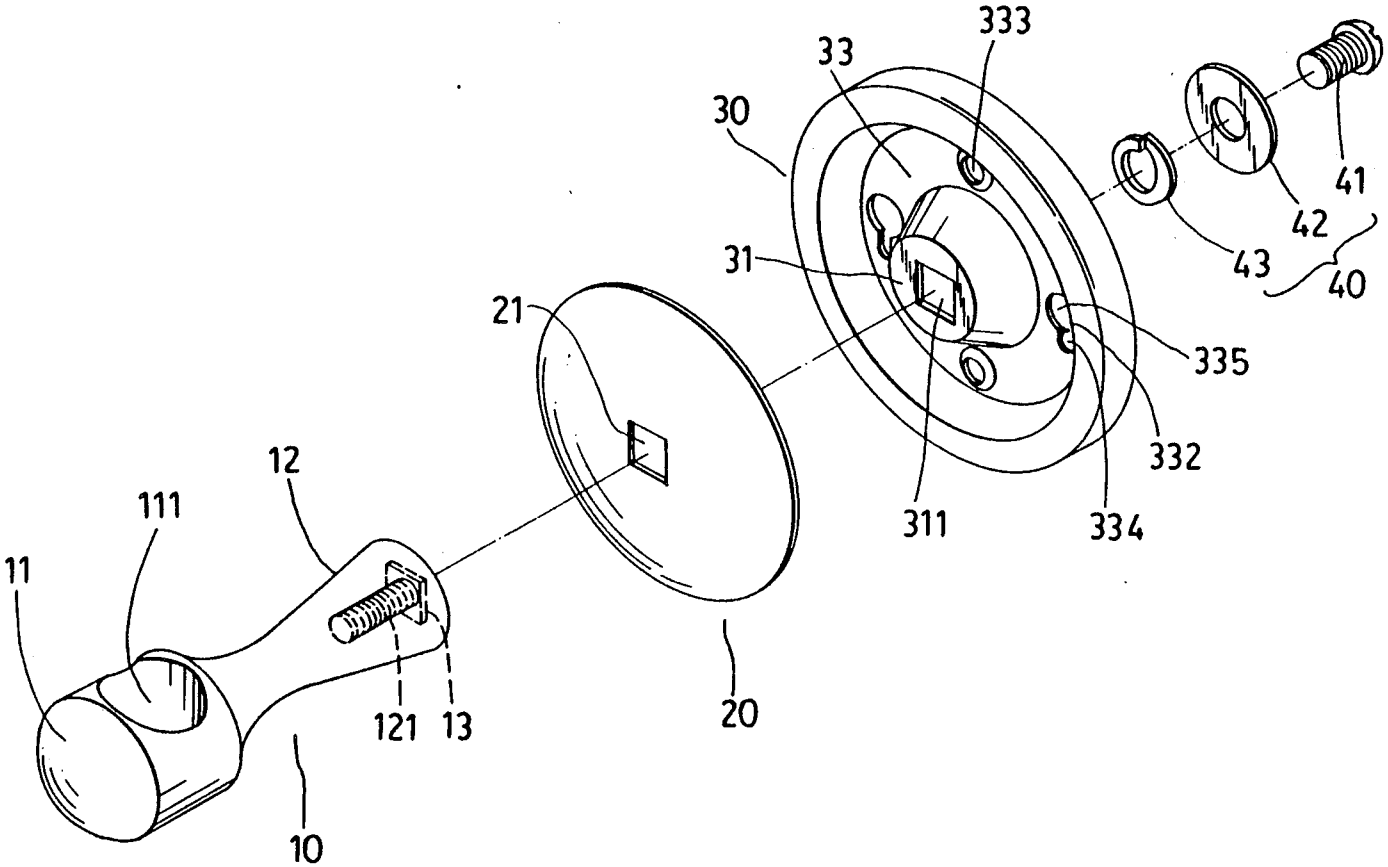
FIG. 2 is an exploded view of a preferred embodiment of a wall fixture of the present invention.

FIG. 2 shows an exploded view of a wall fixture according to the present invention. As illustrated, it includes a post (10) having top end (11) and a bottom end (12). The post can be made of any material. The top end has an enlarged head with a longitudinal groove (111) formed therethrough. The axis of the hole is perpendicular to the axis of the post (10). The bottom end (12) of the post (10) has a threaded socket (121) of predetermined length. The bottom end further has a rectangular protrusion (13) extending from around the threaded groove (121).

Figure 4:
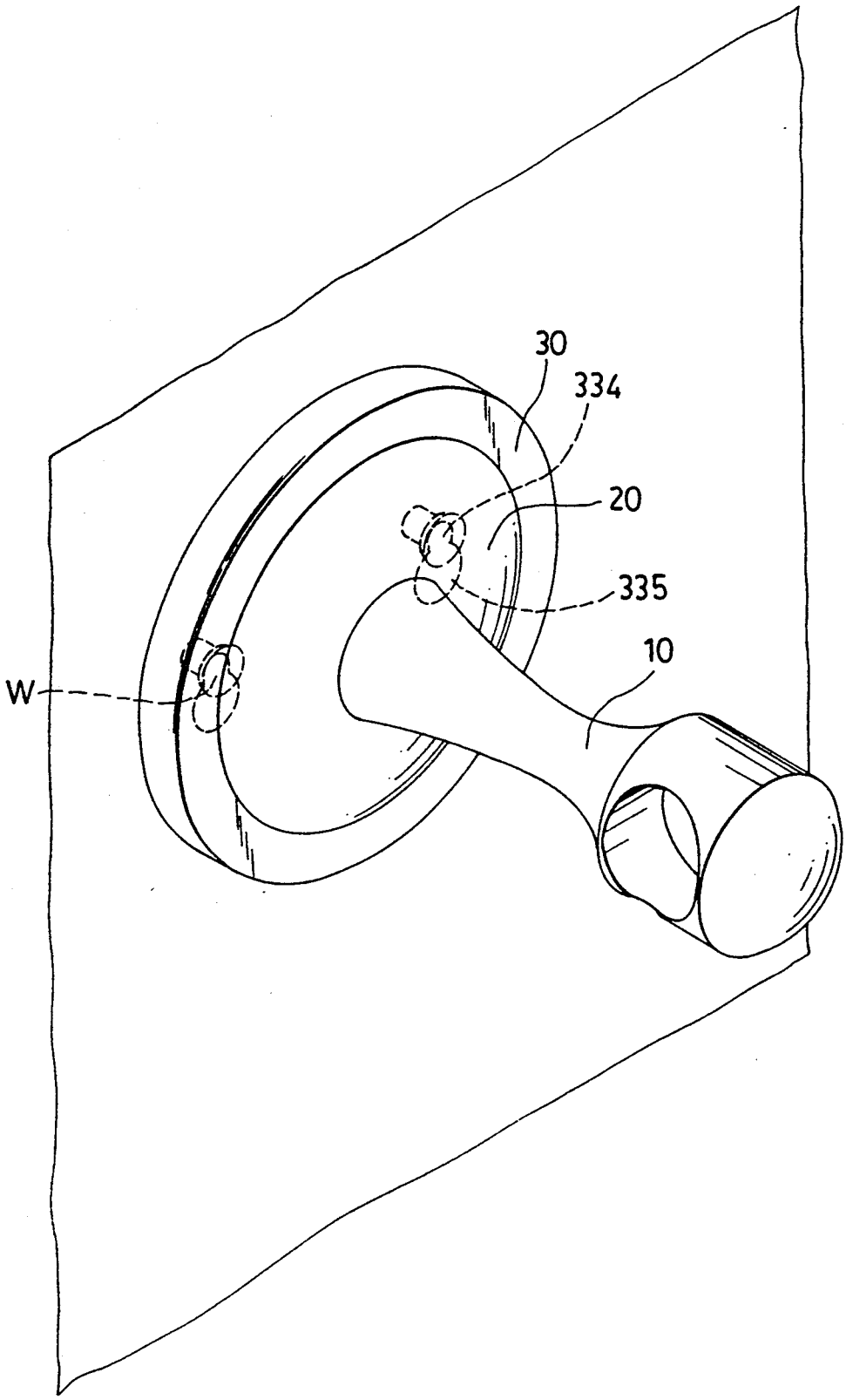
FIG. 4 is a wall fixture of the present invention, being on a wall.

A disc member (30), generally made of of copper and produced by a pressing method, has a recessed groove (33) formed therein. The recessed groove (33) has a central protrusion portion (31) with a first through-hole (311), extending upwardly therefrom. Two pairs of mounting holes (332, 333) are provided in the recessed groove on either side of the protrusion portion of the same. One pair of the mounting holes (332) has a narrow portion (334) and a large portion (335) which are in communication with one another. The disk member (30) can be mounted on a pair of screw (W) fixed in a wall for that purpose by guiding the heads of the screws through the large portion of the holes and then rotating the disc member so that the narrow portion of the holes, engages the screw heads, as shown in FIG. 4.

It is because of this special design of the hole that the disc member of the present invention can be mounted on a wall firmly and yet detachably, which prior art fixtures are not capable of.

Figure 3:
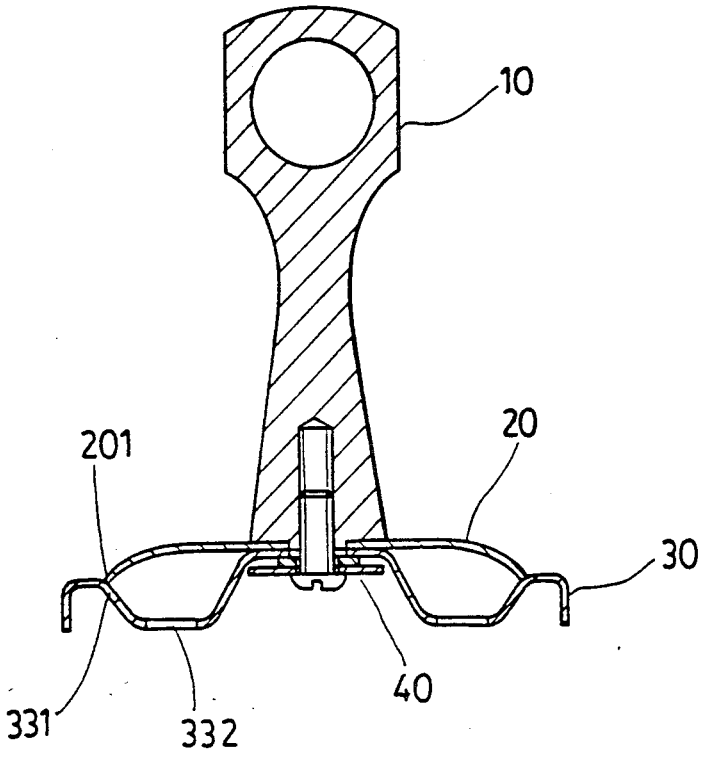
FIG. 3 is a cross sectional view of the wall fixture of FIG. 2.

A cover plate (20), can be made of any material, has a second rectangular hole (21) thereon. When placed properly on top of the disc member (30), the periphery (201) of the cover plate (20) fits in the periphery (331) of the recessed groove (33) and at the same time abuts the protrusion portion of the same. In this arrangement, the two rectangular holes aligned. The rectangular protrusion (13) of the bottom end of the post is inserted into the rectangular hole (21) of the cover plate (20) so that, the threaded socket (121) is also in alignment with the two rectangular holes. Since the rectangular protrusion of the bottom end of the post snugly fits the two rectangular holes, it can not rotate with respect to these two holes. A screw member (40) is inserted through the rectangular holes and into the socket and is threadably engaged therein, as shown in FIG. 3.

Figure 5:
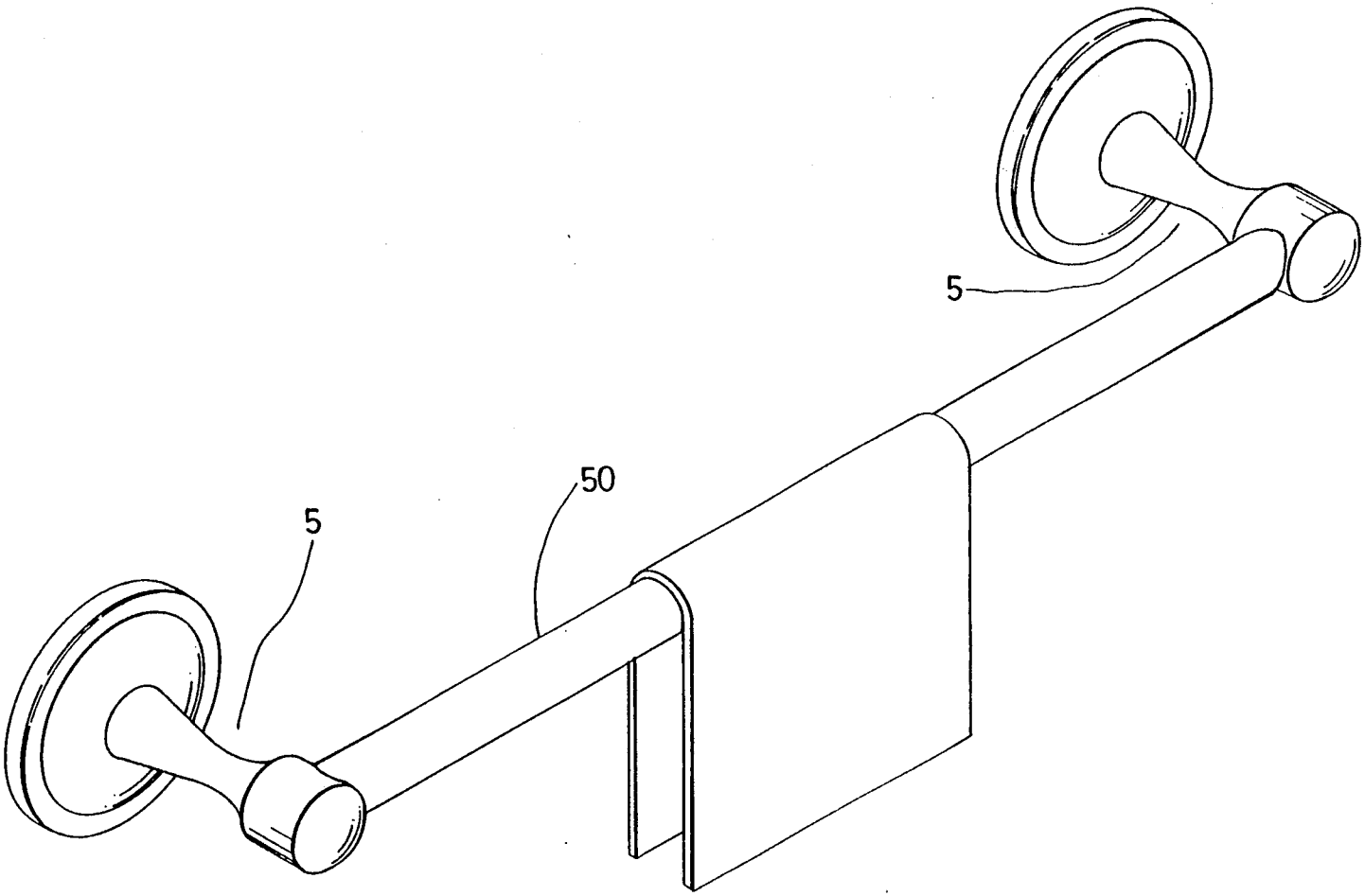
FIG. 5 shows the wall fixtures of the present invention use.

A metal bar (50) or any similar thing can be inserted into the longitudinal holes of two posts of two such fixtures (5), which are afterward mounted on a wall as shown in FIG. 5. A towel or clothing can be hung on the bar (50).

Figure 6:
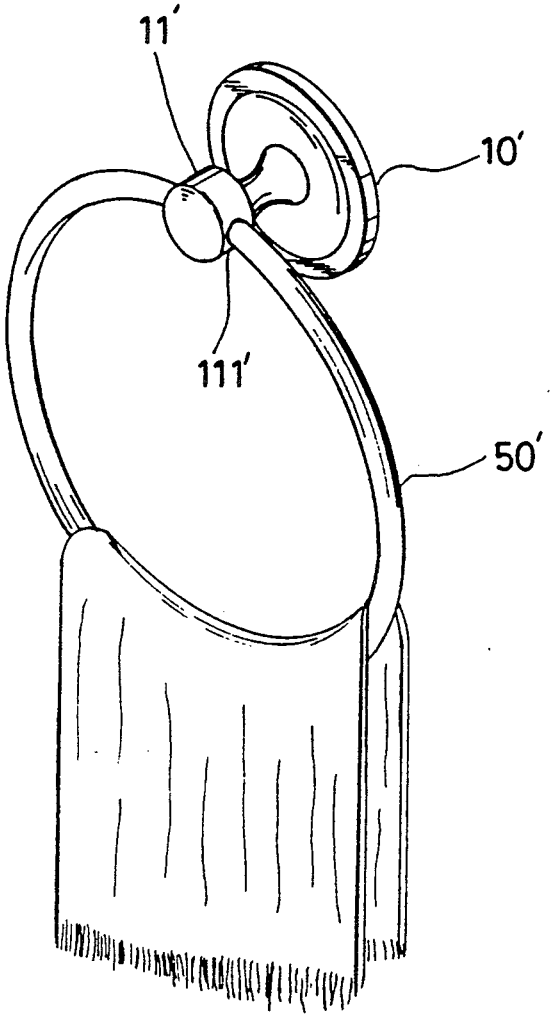
FIG. 6 another preferred embodiment of a wall fixture of the present invention.

In another embodiment, the longitudinal hole (111) in the enlarged head (11') of the post is bored clear through the post, so that a ring (50') can be mounted through the post to serve the same purpose as the bar (50), as shown in FIG. 6.

With the invention thus explained, it is obvious to those skilled in the art that various modifications and variations can be made without departing from the spirit and scope of the present invention. It is therefore intended that the invention be limited only as indicated in the appended claims.

I claim:

1. A wall fixture comprising:

a post having a top end and a bottom end, said top end having an enlarged head including a recess hole, said recessed hole being perpendicular to the axis of said post, said bottom end having a threaded socket extending from said bottom end towards said top end of said post and a rectangular protrusion extending therefrom;

a disc member having a recessed groove formed therein, said recessed groove having a central protrusion portion extending upwardly therefrom, said central protrusion portion having a rectangular first through-hole therethrough, said recessed groove further comprising at least one pair of holes, each of said holes having a narrow portion and a large portion, said narrow and said large portions being in communication with one another;

a cover plate having a rectangular central hole therein, said cover plate being provided on said disc member in such a manner that said cover plate abuts said protrusion portion of said recessed groove and covers the same, said central hole being aligned with said first through-hole of said recessed groove of said disc member, said post being mounted on said cover plate by said bottom end of the same, said threaded socket of said bottom end of said post being aligned with said first through-hole of said recessed groove of said disc member and said central hole of said cover plate; and a screw member passing through said first through-hole of said disc member and central hole of said cover plate to be engaged in said threaded socket of said bottom end of said post, said rectangular protrusion at said bottom end of said post being accommodated snugly in said rectangular first through-hole and said rectangular central hole such that said post cannot rotate with respect to said rectangular holes when said post is properly engaged therein.

2. A wall fixture as claimed in claim 1, wherein said screw member passes through a washer plate and a locking washer before being inserted through said first through-hole and said central hole and engaged in said threaded socket of said bottom end of said post.

* * * * *